US005272826A

United States Patent [19]

Gingras

[11] Patent Number: 5,272,826

[45] Date of Patent: Dec. 28, 1993

[54] MAGNETIC DISPLAY CARD HOLDER

[76] Inventor: Jean-Claude Gingras, 92, rue Durand, Loretteville, (Quebec), Canada, G2B 2B1

[21] Appl. No.: 928,579

[22] Filed: Aug. 13, 1992

[51] Int. Cl.[5] ..... G09F 3/00

[52] U.S. Cl. ..... 40/642; 40/661; 40/621; 40/649

[58] Field of Search ..... 40/642, 649, 630, 600, 40/594, 621; 748/444.2, 444.1, 317, 152, 206.5; D20/43, 44

[56] References Cited

U.S. PATENT DOCUMENTS

| | | | |
|---|---|---|---|
| D. 298,554 | 1/1988 | Zobitz | D20/43 |
| D. 314,017 | 12/1991 | Garfinkle | D20/43 |
| D. 325,401 | 3/1992 | Garfinkle | D20/43 |
| 1,417,325 | 4/1992 | Hopp . | |
| 3,063,183 | 11/1962 | Long | D20/44 |
| 3,881,649 | 5/1975 | Krautsack | 40/642 |
| 3,977,112 | 8/1976 | Breer, II | 40/661 |
| 4,287,676 | 12/1981 | Weinhaus | 40/10 |
| 4,310,978 | 9/1982 | Stern | 40/600 |
| 4,580,360 | 4/1986 | Gribb | 40/638 |
| 4,625,441 | 12/1986 | Fast | 40/661 |
| 4,704,813 | 3/1987 | Fast | 40/11 |
| 4,918,848 | 8/1990 | Stein | 40/584 |

FOREIGN PATENT DOCUMENTS

| | | | |
|---|---|---|---|
| 9003634 | 4/1990 | PCT Int'l Appl. | 40/642 |

*Primary Examiner*—Kenneth J. Dorner
*Assistant Examiner*—C. Hope Davis
*Attorney, Agent, or Firm*—Edwin E. Greigg; Ronald E. Greigg

[57] ABSTRACT

A display card holder fixable to an underside metal surface of a shelf. It comprises a sheet of transparent plastic material, folded in flat segments in order to present the card to be displayed at an angle. The segment to be attached to the underside metal surface of the shelf has a magnet in the form of a strip adhesively fixed thereto.

9 Claims, 2 Drawing Sheets

MAGNETIC DISPLAY CARD HOLDER

FIELD OF THE INVENTION

The present invention relates to a magnetic display card holder to be fixed to an underside metal surface of a shelf.

More particularly, the invention relates to a holder of the above type, that is particularly well adapted for use with conventional shelves having an L-shaped edge.

The card or label holder according to the invention is removably attachable to a metal store shelf by means of a magnet in the form of a strip that may be connected to the underside of the shelf. It may also be designed so that the display card may be easily interchanged whenever desired by simply taking it out from its enclosure and replacing it by a new one.

BACKGROUND OF THE INVENTION

There exists numerous types of display card holders available for different purposes.

U.S. design patent Ser. No. 298,554 discloses a card holder made of a single transparent plastic sheet folded four times in order to provide a card display stand. Other examples of table card holders are disclosed in U.S. industrial design Ser. No. 325,401 and in U.S. Pat. No. 4,704,813.

Some other prior art references disclose display card holders which may be fixed to a shelf. Thus, U.S. design patent Ser. No. 314,017 discloses a card holder made of rigid material, which comprises a clip system attachable to a leg edge of a shelf. U.S. Pat. No. 1,417,325 discloses a ticket holder formed from a single piece of material having a U-shape, which can be inserted onto the edge of the shelf. The card is then maintained in front of the shelf by means of resilient clasps or fingers.

Other apparatus identified in the prior art concern magnet attaching means. See, for example, U.S. Pat. Nos. 4,287,676, 4,310,978 and 4,918,848.

None of the prior art card holders known to the Applicant are designed to be fixed under a metal shelf having an edge with a downwardly extending leg while allowing easy access to the shelf.

SUMMARY OF THE INVENTION

The object of the present invention is to provide a magnetic display card holder to be fixed on a shelf having a top surface, a front edge and an underside metal surface which is very simple in structure and cheap to manufacture and is particularly well adapted for use with a wide variety of metal shelves of different shapes.

More particularly, the invention provides a display card holder which comprises a first member having a magnet fixed thereto for connecting it to the underside of the shelf, a second member, and a third member for holding a display card to be placed in front of the shelf edge, the third member including card attaching means to attach the card to the third member. The second member joins the first member to the third one.

According to a preferred embodiment of the invention, the holder is made of a resiliently flexible single sheet of transparent plastic material that is folded to form the first, second and third members.

To better understand the invention, a non-restrictive description of a preferred embodiment will now be given with reference to the appended drawings.

DETAILED DESCRIPTION OF THE PREFERRED EMBODIMENT

Figure 1:
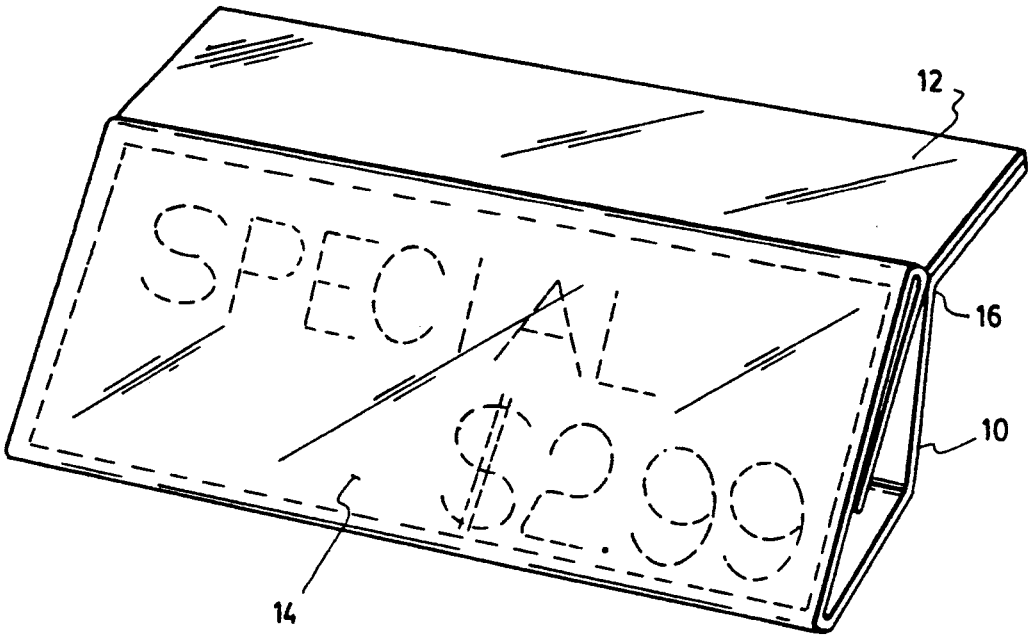
FIG. 1 is a perspective view of a magnetic display card holder according to the preferred embodiment.

The magnetic display card holder according to the invention as shown in the drawings comprises a single folded sheet 10 of resiliently flexible plastic material, preferably, that is folded along four parallel lines to define five members and segments A, B, C, D, E that are generally rectangular in shape.

The first member A is flat and has a front edge 16 which corresponds to one of the folding lines. The two successive segments B and C define together a second member which is substantially L-shaped. The segment B extends perpendicularly to the first member A from the front edge 16 thereof. The second segment C extends substantially parallel to the first member A and has also a front edge 18 which corresponds to another one of the folding lines.

The third member D extends upwardly rearwardly at an angle from the front edge 18 of the L-shaped second member (B, C) up to the front edge 16 of the first member A.

The third member D has an upper free edge that is folded back so as to extend flatly against it. This folded free edge, hereinafter called segment E, defines with the member D a flat pocket for inserting a display card 14. Of course, at least the third member D and preferably the whole holder must be made of a plastic material that is transparent to allow the card 14 to be seen. If not, this card 14 may be attached externally onto the third member D, as shown in dotted lines in FIG. 2.

A magnet 12 is attached to the first member A. This magnet 12 is preferably in the form of a strip glued to the first member.

Figure 2:
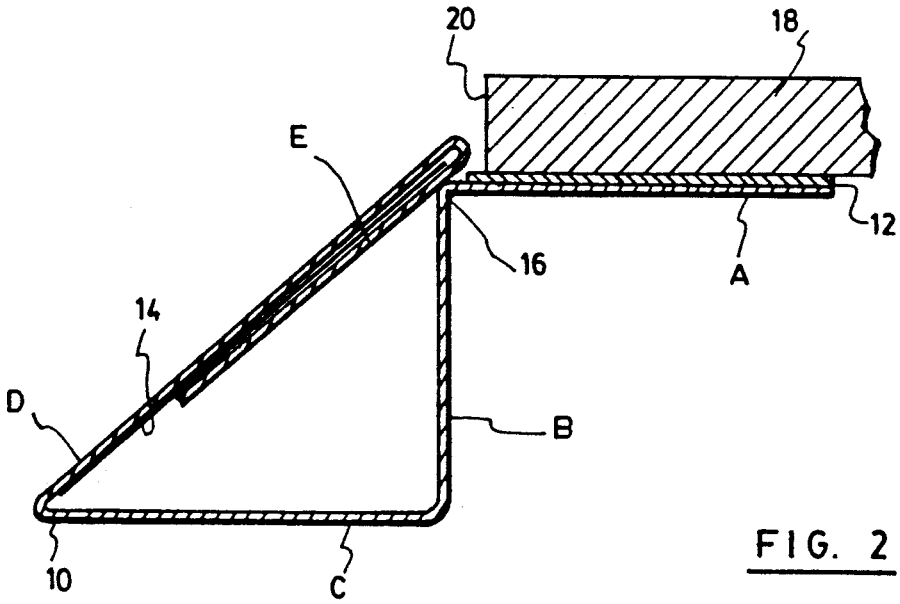
FIG. 2 is a side elevational view of the holder of FIG. 1.
Figure 3:
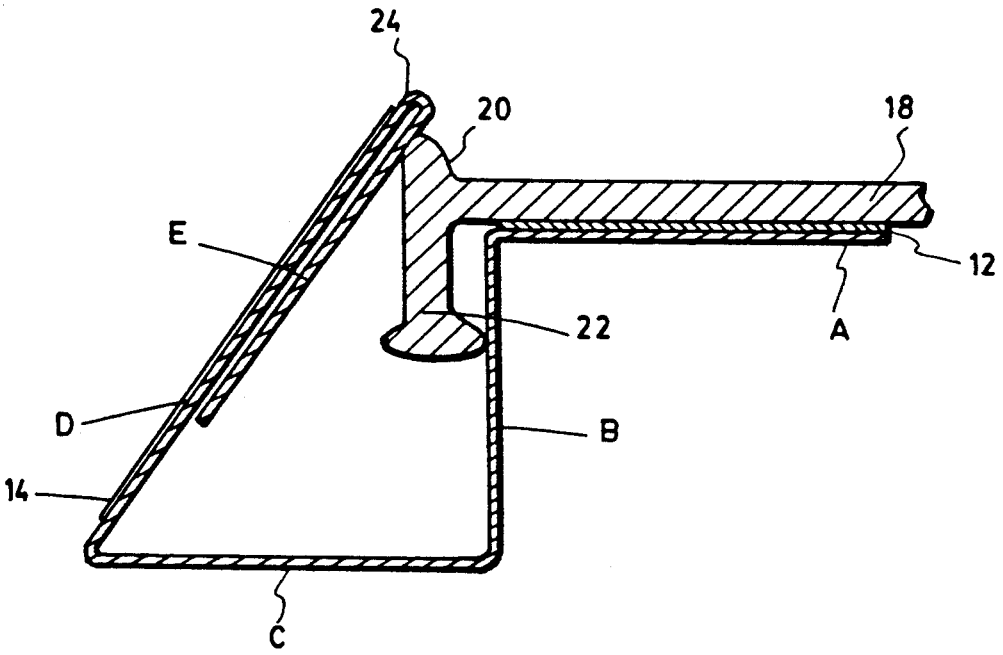
FIG. 3 another side elevational view of the holder, showing its display card member lifted up to give room to the edge of a shelf.

In use, as is shown in FIGS. 2 and 3, the display card holder can be fixed onto a shelf 18 made of metal or having at least an underside metal surface by mere application of its magnet 12 under the shelf adjacent the front edge 20 thereof. As can be seen in FIG. 3, the L-shaped of the second member gives room the downwardly extending leg 22 of the front edge 20, when the front edge is L-shaped. This room is "adjustable" thanks to the flexibility of the holder which allows the third member D to move away from the edge 16.

In this operative position, the top edge 24 of the third member D of the holder extends substantially at the same level as the top surface of the shelf.

It is worth mentioning that this particular way of positioning a display card presents two major advantages. First, it permits the desired information to be kept in view, just in front of the shelf and not above the same. This gives easy access to the shelf, making the removal of objects stored on this shelf easier. It also allows easy access to the bottom shelf, since thanks to its positioning, the holder does not obstruct the space below the shelf and they does not risk causing confusion of identification of products on the shelf.

As aforesaid, segment E may be omitted. The display card may then be just held between the edge 20 of the shelf and the back of the third member. In this embodiment, the third member D must still be made of transparent plastic material.

In another embodiment, the display card may be adhesively fixed as a "sticker" on the member D. In this other embodiment, the segment E may be omitted and the plastic material does not have to be transparent.

Instead of using a magnet in the form of a strip, use could be made of rigid magnets snapped or otherwise fixed onto the first segment A. It is therefore obvious that modifications could easily be made to the holder described hereinabove without departing from the scope of the invention as reflected in the appended claims.

What is claimed is:

1. A display card holder for use with a shelf having a top surface, a front edge having a downwardly projecting leg and an underside metal surface parallel to said top surface, said holder comprising:

a first member having a magnet fixed thereto, for connecting said first member to the underside surface of the shelf;

a second member joined to said first member for extending from said first member around said leg, said second member being substantially L-shaped with a first segment extending perpendicular to said first member and a second segment extending perpendicular to said first segment at a first end of said first segment; and a third member connected to said second segment at an opposite end of said second segment, said third member including card attaching means for holding a display card in front of said front edge of said shelf;

wherein said second member holds said third member with respect to said first member such that said card may be held by said attachment means before said front edge with a top of said card being substantially at a same level as said top surface of the shelf.

2. The display card holder of claim 1, wherein said first, second and third members are segments of a single sheet of plastic material folded along parallel lines.

3. The display card holder of claim 2, wherein said magnet is in the form of a strip glued to said first member.

4. The display card holder of claim 2, wherein said plastic material is resiliently flexible.

5. A display card holder for use with a shelf having a top surface, a front edge and an underside metal surface, said holder comprising:

a first member having a magnet fixed thereto for connecting said first member to the underside surface of the shelf;

a second member joined to said first member; and a third member connected to the second member, said third member including card attaching means for holding a display card in front of said front edge of the shelf; wherein:

said first, second and third members are segments of a single sheet of resiliently flexible plastic material folded along parallel lines;

said first member is flat and has a front edge;

said second member is substantially L-shaped and has a first flat segment that extends downwardly and perpendicularly to the first member from the front edge of the first member, and a second flat segment that extends forwardly and perpendicularly to said first segment and has also a front edge; and said third member is flat and extends upwardly rearwardly at an angle from the front edge of the L-shaped second segment up to the front edge of the first member.

6. The display card holder of claim 5, wherein said magnet is in the form of a strip glued to said first member.

7. The display card holder of claim 5, wherein said plastic material is transparent and said third member has an upper segment that is folded back, and extends in a substantially planar relationship with said third member, to define therewith a pocket for receiving the display card.

8. The display card holder of claim 7, wherein said magnet is in the form of a strip glued to said first member.

9. The display card holder of claim 1, wherein said magnet is in the form of a strip glued to said first member.

* * * * *